US007000276B2

(12) United States Patent
Chaffee

(10) Patent No.: US 7,000,276 B2
(45) Date of Patent: Feb. 21, 2006

(54) BODY SUPPORT SURFACE COMFORT DEVICE

(76) Inventor: Robert B. Chaffee, 78 Montgomery St., Boston, MA (US) 02116

( * ) Notice: Subject to any disclaimer, the term of this patent is extended or adjusted under 35 U.S.C. 154(b) by 0 days.

(21) Appl. No.: 10/412,075

(22) Filed: Apr. 11, 2003

(65) Prior Publication Data

US 2003/0192123 A1 Oct. 16, 2003

Related U.S. Application Data

(60) Provisional application No. 60/374,878, filed on Apr. 23, 2002, provisional application No. 60/371,960, filed on Apr. 11, 2002.

(51) Int. Cl.
*A47C 16/00* (2006.01)

(52) U.S. Cl. ..... 5/655.3; 5/654

(58) Field of Classification Search ..... 5/665.3, 5/654, 706, 644; 137/223, 232, 527, 854; 251/82, 297

See application file for complete search history.

(56) References Cited

U.S. PATENT DOCUMENTS

| | | | | |
|---|---|---|---|---|
| 388,037 | A | 8/1888 | Hargin | |
| 918,391 | A | 4/1909 | Taarud | |
| 934,465 | A | 9/1909 | Rust | |
| 1,282,980 | A | 10/1918 | Takach | |
| 1,468,072 | A * | 9/1923 | Ogle | 5/654 |
| 1,576,211 | A | 3/1926 | O'Kane | |
| 1,944,466 | A | 1/1934 | Rubin | |
| 2,369,736 | A | 2/1945 | Hurt | |
| 2,372,218 | A | 3/1945 | Manson et al. | |
| 2,415,150 | A | 2/1947 | Stein | |
| 2,434,641 | A | 1/1948 | Burns | |
| 2,549,597 | A | 4/1951 | Harris | |
| 2,575,764 | A | 11/1951 | Morner | |
| 2,604,641 | A | 7/1952 | Reed | |
| D167,871 | S | 9/1952 | Vega | |
| 2,614,272 | A | 10/1952 | Morner | |
| 2,672,628 | A | 3/1954 | Spanel | |
| 2,741,780 | A | 4/1956 | Kimbrig | |
| 2,842,783 | A | 7/1958 | Druck | |
| 2,853,720 | A | 9/1958 | Friedlander | |
| 3,008,214 | A | 11/1961 | Foster et al. | |
| 3,017,642 | A * | 1/1962 | Rosenberg et al. | 5/709 |
| 3,042,941 | A | 7/1962 | Marcus | |
| 3,128,480 | A | 4/1964 | Lineback | |

(Continued)

FOREIGN PATENT DOCUMENTS

| | | | | |
|---|---|---|---|---|
| CH | 611144 | * | 5/1979 | 5/706 |

(Continued)

OTHER PUBLICATIONS

PCT International Search Report for International Application PCT/US2005/010047, mailed Aug. 8, 2005.

*Primary Examiner*—Jong-Suk (James) Lee
(74) *Attorney, Agent, or Firm*—Lowrie, Lando & Anastasi, LLP

(57) ABSTRACT

An adjustable, inflatable surface comfort device to be used with shaped body support devices. The surface comfort device comprises an inflatable bladder having a shape and size to substantially cover at least one support surface of a shaped body support device so as to conform to and provide a comfort layer to the body support device. According to one embodiment, a self-sealing valve is coupled to a port of the inflatable bladder, and is constructed and arranged to enable all of inflation, deflation, and comfort control of the surface comfort device.

38 Claims, 11 Drawing Sheets

U.S. PATENT DOCUMENTS 3,155,991 A 11/1964 Dunham
3,274,624 A 9/1966 Noerdinger
3,296,635 A 1/1967 O'Hanlan
3,505,695 A * 4/1970 Bishaf et al. ..... 137/228
D220,953 S 6/1971 Des Pres
3,772,717 A 11/1973 Yuen et al.
3,790,975 A 2/1974 Werner et al.
3,798,686 A 3/1974 Gaiser
3,813,716 A 6/1974 Francis
3,840,922 A 10/1974 Morrison et al.
3,864,766 A 2/1975 Prete, Jr.
3,877,092 A 4/1975 Gaiser
4,025,974 A 5/1977 Lea et al.
4,091,482 A 5/1978 Malcolm
4,099,773 A 7/1978 Chang
4,149,285 A 4/1979 Stanton
4,169,295 A 10/1979 Darling
D253,983 S 1/1980 McRight
4,317,244 A * 3/1982 Balfour-Richie ..... 5/706
4,348,779 A 9/1982 Leber
4,370,769 A * 2/1983 Herzig et al. ..... 5/654
4,371,999 A 2/1983 Reid
4,405,129 A 9/1983 Stuckey
4,445,240 A * 5/1984 Voorhees ..... 5/655.5
4,528,705 A 7/1985 Greenawalt
4,579,141 A * 4/1986 Arff ..... 137/223
4,594,743 A 6/1986 Owen et al.
4,644,597 A 2/1987 Walker
4,807,554 A 2/1989 Chi-Hung
4,862,533 A 9/1989 Adams
4,896,389 A 1/1990 Chamberland
4,905,332 A 3/1990 Wang
4,955,665 A * 9/1990 Richer ..... 5/417
4,964,183 A 10/1990 LaForce, Jr.
4,970,741 A 11/1990 Spina
4,977,633 A 12/1990 Chaffee
4,982,466 A 1/1991 Higgins et al.
4,999,074 A 3/1991 Afeyan
5,044,030 A 9/1991 Balaton
5,068,933 A 12/1991 Sexton
5,079,785 A 1/1992 Garcia
5,117,517 A 6/1992 Su
5,163,196 A 11/1992 Graebe et al.
D335,999 S 6/1993 Van Driessche
5,226,184 A 7/1993 Cheng
5,243,722 A 9/1993 Gusakov
5,267,363 A 12/1993 Chaffee
D343,980 S 2/1994 Torchia
5,333,336 A * 8/1994 Langsam ..... 5/654
5,343,889 A * 9/1994 Jaw ..... 137/232
5,367,726 A 11/1994 Chaffee
5,471,690 A * 12/1995 McNeil ..... 5/644
5,493,742 A 2/1996 Klearman
5,497,519 A 3/1996 Mintz
5,598,593 A 2/1997 Wolfe
5,619,764 A 4/1997 Lopau
5,638,565 A 6/1997 Pekar
5,689,845 A 11/1997 Sobieralski
5,699,569 A 12/1997 Schwarz-Zohrer
D391,435 S 3/1998 Song et al.
5,845,352 A 12/1998 Matsler et al.
D405,636 S 2/1999 Stewart
5,898,963 A 5/1999 Larson
5,902,011 A 5/1999 Hand et al.
5,947,563 A 9/1999 Klimenko
5,951,111 A 9/1999 Klimenko
D414,976 S 10/1999 Su et al.
5,960,495 A * 10/1999 Hsu et al. ..... 5/706
5,963,997 A 10/1999 Hagopian et al.
5,970,545 A * 10/1999 Garman et al. ..... 5/615
6,012,188 A * 1/2000 Daniels et al. ..... 5/654
6,076,214 A 6/2000 Klimenko
6,102,759 A 8/2000 Klimenko
6,131,219 A 10/2000 Roberts
6,148,461 A 11/2000 Cook et al.
6,152,530 A 11/2000 Hsu et al.
6,189,168 B1 2/2001 Graebe
6,196,260 B1 * 3/2001 Pekar ..... 137/512.15
D441,586 S 5/2001 Su
6,224,444 B1 5/2001 Klimenko
6,226,820 B1 * 5/2001 Navarro ..... 5/655.5
6,237,621 B1 5/2001 Chaffee
6,237,653 B1 5/2001 Chaffee
6,240,584 B1 6/2001 Perez et al.
D448,229 S 9/2001 Su et al.
6,283,056 B1 9/2001 Tchaikovsky
6,345,401 B1 2/2002 Frydman
6,397,417 B1 6/2002 Switlik
6,397,419 B1 6/2002 Mechache
6,446,289 B1 9/2002 Su et al.
D464,225 S 10/2002 Boso et al.
6,568,011 B1 5/2003 Fisher et al.
6,701,559 B1 3/2004 Boso et al.
6,804,848 B1 10/2004 Rose
2002/0050010 A1 5/2002 Shimada
2002/0116765 A1 8/2002 Smith et al.
2002/0184710 A1 12/2002 Chaffee
2003/0028971 A1 2/2003 Chaffee
2003/0066489 A1 4/2003 Whitehill
2003/0200611 A1 10/2003 Chaffee
2004/0107503 A1 6/2004 Tu

FOREIGN PATENT DOCUMENTS

EP 0786219 A1 7/1997
GB 2140294 A 11/1984

* cited by examiner

BODY SUPPORT SURFACE COMFORT DEVICE

RELATED APPLICATIONS

This application is a non-provisional of and claims priority under 35 U.S.C. § 119(e), to provisional application Ser. No. 60/371,960, filed Apr. 11, 2002, and provisional application Ser. No. 60/374,878, filed Apr. 23, 2002. The contents of these prior application specifications are incorporated herein by reference.

FIELD OF THE INVENTION

The present invention relates to an inflatable surface comfort device which may be used with body support devices or as a stand alone comfort device.

DISCUSSION OF THE RELATED ART

It is to be understood that a body support structure or body support device, as used herein, includes, for example, a chair seat, a chair back, a head rest, a leg or foot support device, or any other structure or device that is used for, for example, sitting, reclining, lying down, or supporting a person. A body support structure or device typically may be beveled, contoured, angled, or some how shaped for, for example, sitting, reclining and the like. Such body support devices or structures may comprise a solid surface, a padded surface, an upholstered surface, and may also comprise any number of types of support structure, such as foam, springs, suspension straps, and the like.

It is often desirable to provide comfort and/or support layers to existing body support structures, such as chairs, car seats, mattresses, and the like. There have been a number of different products offered and sold in the marketplace that attempt to provide such comfort and support. For example, there are contoured foam and foam covered structures that can be used with a car seat. There are also wooden beaded structures that can be attached to the back of a car seat and purportedly provide support or comfort to a person sitting in the car seat. As another example, there are sporting event seats made of foam and other synthetic materials and typically encased in a flexible plastic covering, which can be, for example, placed on top of metal or wooden benches at a sporting activity. As another example, many automobiles are provided with a lumbar support that is built into a base of a back of the car seat, that can be adjusted, typically by moving a lever or rotating a knob, to vary the amount of support and/or comfort provided by the lumbar support. These are just some examples of comfort or support devices that have been used in the marketplace.

Some of these devices comprise a layer of foam which can be placed over the body support structure or device to provide a layer of comfort. The layer of foam may have a contour and may be surrounded or covered, for example, by an outer protective layer of plastic, fabric, or any other covering layer known to those of skill in the art. One problem with these foam layer devices is that the foam layer must be thin to accommodate shaped devices, and foam is a compressible material which compacts at a point where pressure is applied. For example, by applying pressure to the thin foam layer, for example by sitting on the thin foam layer, a pressure point results from where the foam is compacted to the underlying body support device. Thus, the thin layer of foam typically does not equally distribute the applied pressure or weight and typically provides at least one pressure point and discomfort point to the user of the thin foam device. Another problem with foam devices is that the performance of foam degrades over time and can vary with environmental conditions.

Referring to FIG. 1, there is illustrated a thin foam device 100 may have in a thickness t of less than 2 inches and a surface 102 providing pressure on the thin foam device, which results in pressure points 104, 106, 108 and 109, as illustrated. As can be seen from FIG. 1, the pressure point 104 has a magnitude A which a represents pressure point of most pressure and pressure point 110 has a magnitude D which represents a pressure point of least pressure in a range A–D of magnitudes of pressure experienced with the thin foam layer. As can be seen from FIG. 1, the thin foam layer does not equally distribute the applied pressure and compacts to provide at least one area 111 with a pressure point 104 that may be uncomfortable. In addition, the thin foam device 100 does not supportively conform to a surface or subject applying pressure to the thin foam device. Further, the thin foam device may not typically conform to the body support device that it is used with.

Another example of surface comfort devices includes inflatable devices, including, inflatable pillows, inflatable rafts, inflatable mattresses, and the like. However, one problem with some inflatable devices is that they may not be self-sealing, thus requiring a user to fumble with a valve when inflating the device. For example, many inflatable devices comprise stem-type valves, that require removing a cover or mating piece to inflate the inflatable device, and then inserting the cover or mating piece to maintain the fluid within the inflatable device. These valves are clumsy, are not self-sealing and thus are difficult to adjust an amount of fluid in the device. For example, a user must blow into the stem valve, then quickly insert the mating piece to maintain the fluid pressure. Another problem with some inflatable devices is that the inflatable devices are not intended to be used with shaped or cushioned surfaces, and instead are intended to be used on a flat surface. For example, an inflatable mattress is used as a body support device itself, and is typically used on a floor or a flat surface. However, an inflatable mattress would not work well with and would not conform with a shaped surface.

As another example, referring to FIGS. 2 and 3, there is illustrated an inflatable device 10 that is intended to be used on a flat surface such as a floor or a bench-type seat as a seat cushion. However, the problem with device 10 is that it is not shaped to be used with a shaped surface. In addition, the device 10 is typically not sized to be compatible with the body support structure. For example, the size of the device is not typically large enough to cover the entire surface 12 of the seat 13 of the chair 9. In addition, the device 10 is typically thick, such as for example greater than 2 inches in thickness, since it is intended to be used with a flat surface and to provide cushioning to a subject sitting on the device 10 placed on the flat surface. However, the thickness of the device and the size of the device make it impractical to be used with a shaped surface such as the surface 12 of the seat 13. In particular, the device 10 does not over spread the entire surface 12 and does not conform to the shape of the surface 12. In addition, when the device is not fully inflated, it tends to move around the surface 12 and provide an unbalanced cushioning. Thus, the device 10 is ergonomically incompatible with a shaped surface such as the surface 12 and, does not overspread the entire surface 12, and can be unstable to use with a shaped surface. Further, the device 10 may not have a mechanism for adjusting an amount of fluid within the device 10, to adjust an amount of support or comfort that the device 10 provides. For example, the device may have a stem valve as discussed above which requires fumbling with the valve and the mating cover in order to inflate or adjust the amount of fluid in device 10, and therefore there is no easy adjustment mechanism to adjust the amount of fluid in the device 10.

SUMMARY OF THE INVENTION

In view of the problems and disadvantageous of the above described structures, there is a need to find an alternative to the thin foam surface comfort devices as well as the inflatable devices described above. In particular, there is a need for a device that can conform to a shaped surface, a beveled surface, a contoured surface, a cushioned surface and the like, and that can equally distribute pressure applied to the device, for example, when one sits on a device that is overlaying a shaped surface. In addition, there is a need to provide a device that can easily be adjusted to vary the level of comfort and support provided by the device, and that can be adaptable for use by a variety of users of different body types and sizes, in a variety of user settings (used over a variety of body support devices, in a variety of locations). Further, there is a need for a device that conforms to a surface that applies pressure to the device.

According to one embodiment of the invention, there is provided a self-sealing, inflatable, comfort device that comprises an inflatable bladder having a single port through which inflation and deflation of the inflatable bladder is accomplished. The inflatable bladder is sized and shaped to conform to a shaped body support device and to provide a comfort layer to be used with the body support device. The surface comfort device also comprises a self-sealing valve coupled to the single port of the inflatable bladder, that is constructed and arranged to enable all of inflation, deflation and comfort control of the surface comfort device with the self-sealing valve.

Some examples of this embodiment of the surface comfort device include a seat cushion, a pillow, a lumbar support, a cylindrical tube, and a body pillow.

Another embodiment of an adjustable, inflatable, surface comfort device comprises an inflatable bladder having a shape and a size such that the surface comfort device substantially covers and conforms to substantially all of at least one body support surface of a shaped body support device. In addition, the surface comfort device comprises an adjustment mechanism that provides for inflation, deflation, and adjustment of an amount of fluid within the inflatable bladder, to adjust a comfort and support provided by the surface comfort device.

Some examples of this embodiment of the surface comfort device also include a seat cushion, a pillow, a lumbar support, a cylindrical tube, and a body pillow.

BRIEF DESCRIPTION OF THE DRAWINGS

Various features and aspects of embodiments of the invention will be apparent from the following non-limiting discussion, with reference to the accompanying figures. In the figures, in which like reference numerals represent like elements throughout the different figures.

DETAILED DESCRIPTION

It is to be understood that a body support structure or a body support device, as used herein, includes, for example, a chair seat, a chair back, a head rest, a leg or foot support device, or any other structure or device that is used for, for example, sitting, reclining, lying down, or supporting a person. A body support structure or device typically may be beveled, contoured, angled, or some how shaped for, for example, sitting, reclining, and the like. Such body support devices or structures may comprise a solid surface, a padded surface, an upholstered surface, and may also comprise any number of types of support structure, such as foam, springs, suspension straps, and the like.

Figure 5:
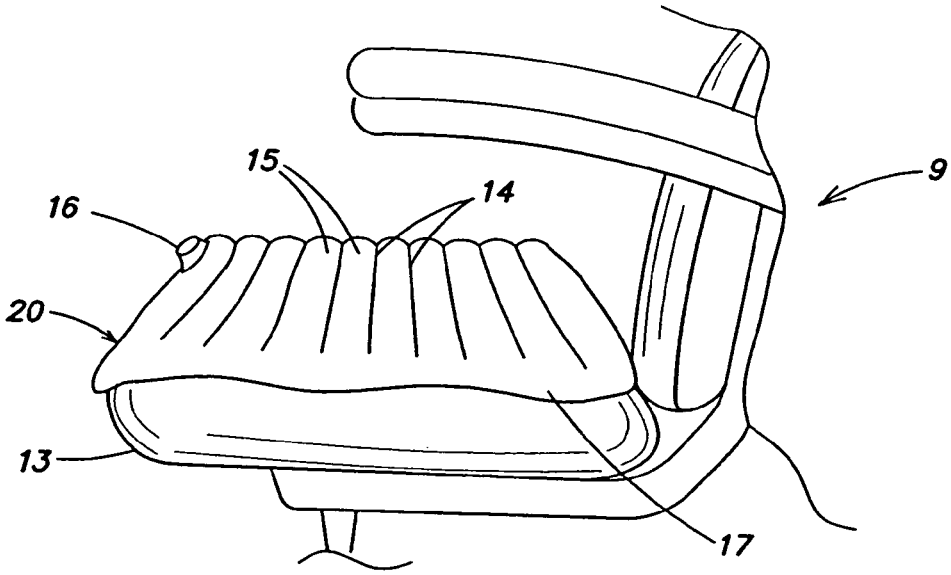
FIG. 5 is a side perspective view of one embodiment of a surface comfort device according to the invention.
Figure 6:
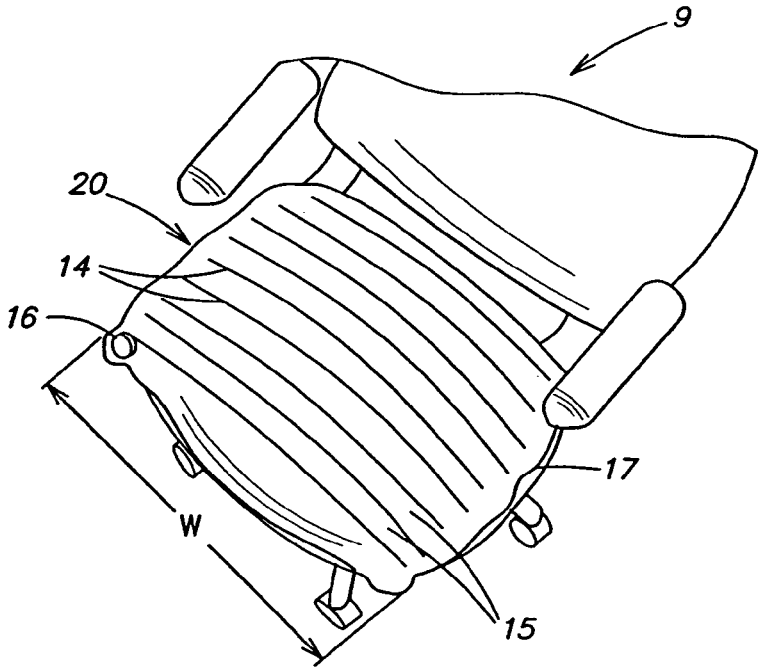
FIG. 6 is a top perspective view of the embodiment of surface comfort device of FIG. 5.

Referring to FIGS. 5–6 there is illustrated one embodiment of a self-sealing, inflatable surface comfort device 20 according to the invention. The surface comfort device 20 is an inflatable device that when at least partially inflated provides a conformable, flexible cushioning layer that may be used in combination with a shaped or cushioned body support device, such as for example, the shaped seat 13 of chair 9 as illustrated in FIGS. 5–6, so as to improve the comfort and/or support of the chair.

Figure 1:
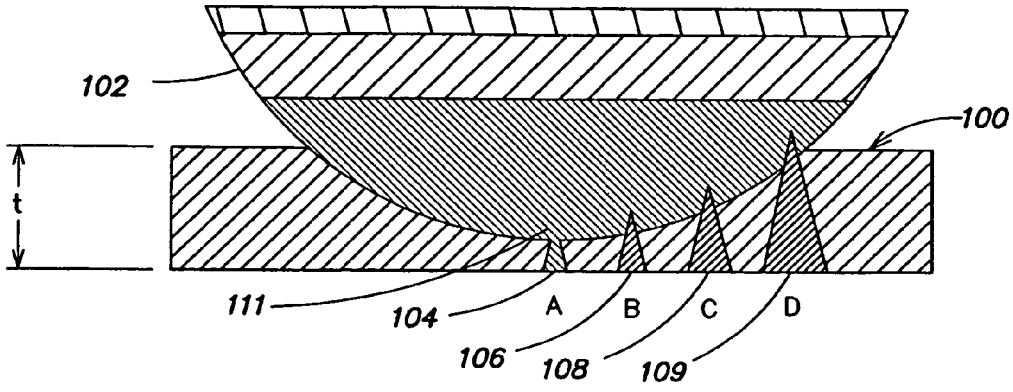
FIG. 1 (PRIOR ART)
FIG. 1 illustrates a thin foam layer of related art surface comfort devices and their inability to equally distribute applied pressure.
Figure 4:
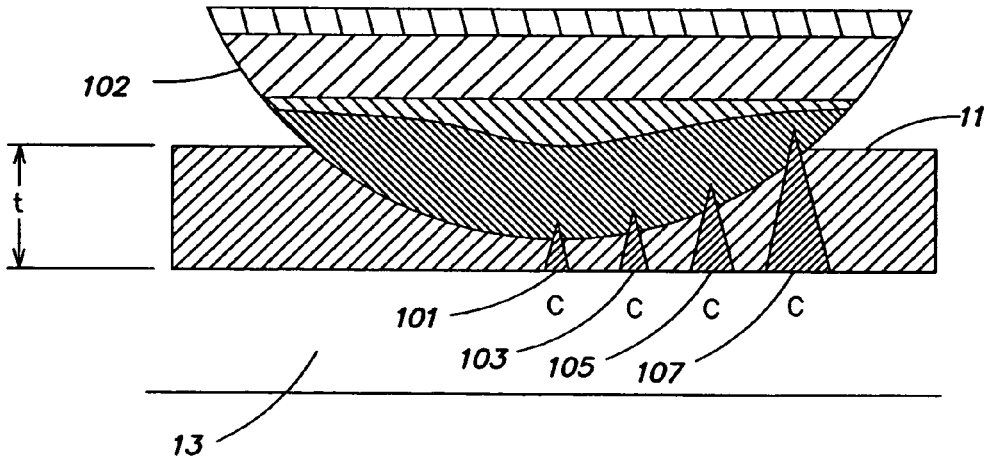
FIG. 4 illustrates how a surface comfort device of the invention comprising an inflatable device can equally distribute applied pressure.
Figure 2:
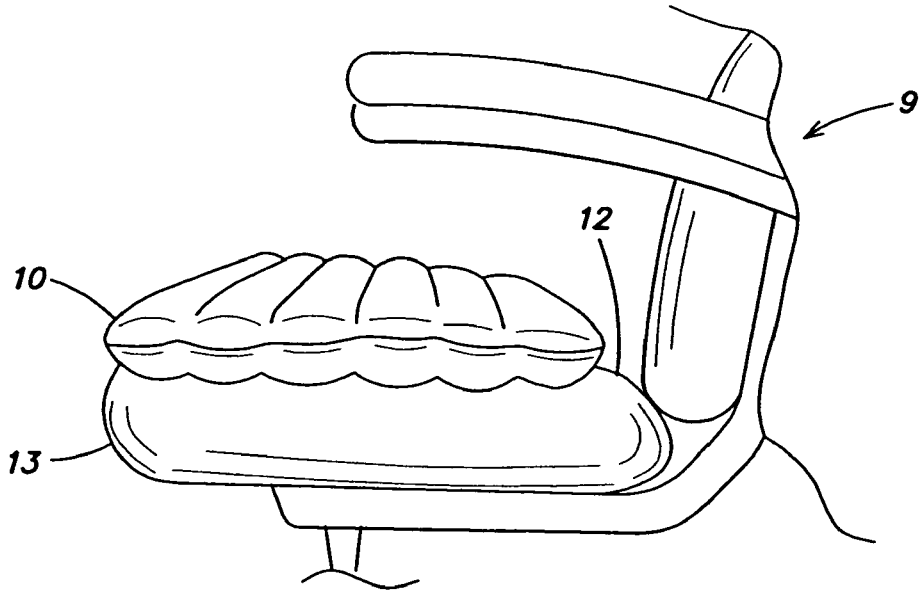
FIG. 2 (PRIOR ART)
FIG. 2 is a side perspective view of an inflatable surface comfort device typically used with a flat surface, such as a floor or bench type seat.
Figure 3:
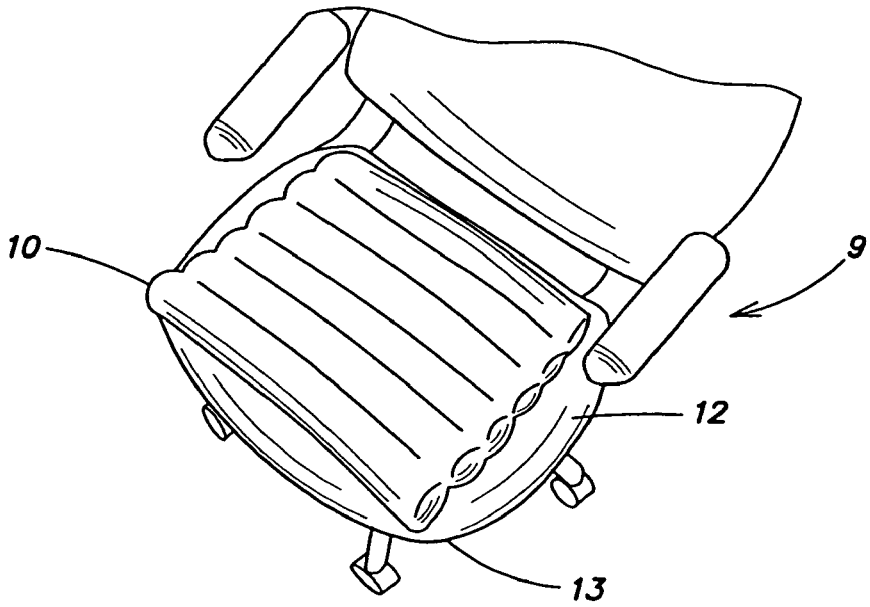
FIG. 3 (PRIOR ART)
FIG. 3 is a top perspective view of the surface comfort device of FIG. 2.

It is to be appreciated that this embodiment of the self-sealing, inflatable surface comfort device of the invention comprises a fluid impervious bladder having a cross-section, such as illustrated in FIG. 4. In particular, this embodiment of the fluid impervious bladder 11 has a thickness t of less than 2 inches. In addition, this embodiment of the fluid impervious bladder 11 comprises a total volume of no more than 0.5 cubic feet of fluid, when fully inflated.

One advantage of the surface comfort device 20 comprising the fluid containing bladder 11, is that the surface comfort device can have the thickness t of less than 2 inches which may be similar to, for example, the thin foam layer discussed above, but the surface comfort device will equally spread the pressure from the pressure applying surface 102, such as one sitting on the surface comfort layer, over an even area thereby eliminating the uncomfortable pressure point that results with the thin foam layer (discussed above). In particular, the bladder 11 compresses and conforms to the pressure applying surface 102 and the underlying surface such as the shaped surface 12 of seat 13. In addition, the bladder provides an equal amount of comfort and pressure along the entire pressure applying surface 102 in contact with the bladder, as illustrated by pressure points 101, 103, 105 and 107 all having substantially equal magnitude of pressure C provide by the bladder. Thus, the inflatable surface comfort device 20 of the invention expands the comfort surface area between the body and the body support device, conforms to the shape of the body support device and the pressure applying surface, and eliminates any pressure points that cause discomfort and negatively impact health and wellness.

It is to be appreciated that the surface comfort device of the invention may be used with all kinds of conventional body support devices such as, for example, a shaped surface 12 of a seat 13 of a chair 9, for adding comfort to an existing seat, as illustrated in FIGS. 5–6. In addition, the surface comfort device 20 may be used with other body support devices such as, but not limited to, home and office furniture, car seats and the like. It is to further be appreciated that the surface comfort device may also be used as a stand-alone comfort device, such as a portable cushion or pillow, and with flat body support devices such as a mattress, a floor and the like. Nevertheless, it is to be understood that one aspect of the surface comfort device of the invention is that it is purposely shaped and sized to substantially cover a body support surface such as, a seat chair or seat back, so that it can be used with the body support device. Accordingly, the surface comfort device may be provided in many shapes and sizes to substantially cover and accommodate a plurality of differently sized and shaped body support devices. It should also be appreciated that the surface comfort device 20 may be provided and used with or without additional layers of various materials to improve comfort and utility of the surface comfort device such as, for example, a textured or quilted cover layer, which can be added for additional comfort, support, protection and the like.

Figure 7:
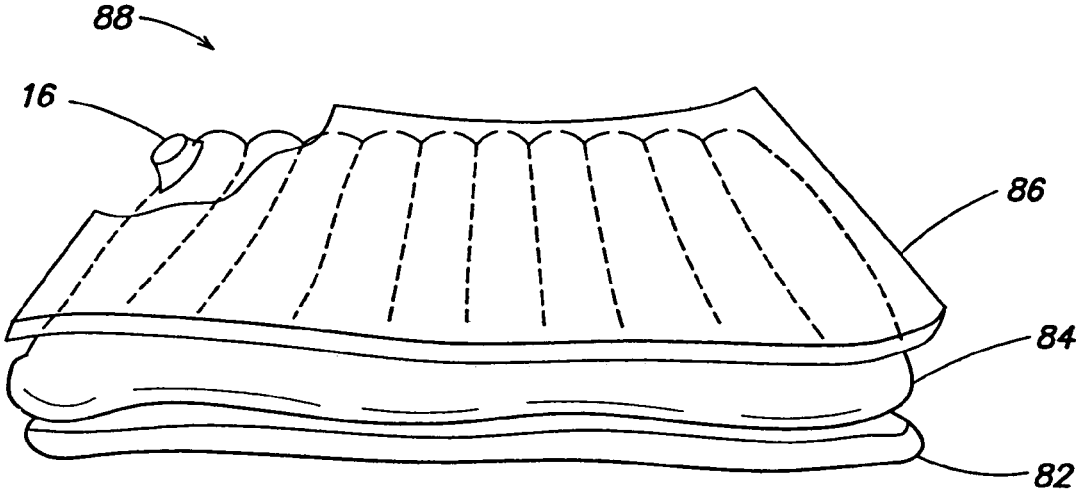
FIG. 7 illustrates another embodiment of a surface comfort device according to the invention.

For example, referring to FIG. 7 there is illustrated another embodiment 88 of a surface comfort device according to the invention. According to this embodiment the surface comfort device comprises a first layer 82, which may be for example a compressible foam or cushioning fabric. The surface comfort device also comprises a second layer 84, which in one embodiment may be an inflatable bladder 11 of the surface comfort device as described herein. The surface comfort device also comprises a third layer 86, which may be, for example, a quilted fabric or a synthetic material, which may include a foam or a textured or contoured cushioning material, or may be fabric sewn with a batting, or a quilted material. An exterior covering layer (not illustrated) of, for example, leather, plastic, or a woven material may also be provided to surround and protect these other layers. It is to be appreciated that this embodiment 88 of the surface comfort device may also include an adjustment device, such as a self-sealing valve 16 to enable inflation and deflation of the bladder, as will be described in further detail herein. It is also to be appreciated that although the self-sealing valve 16 is illustrated as mating with a top layer 86 of the device, it can be provided at any surface of the device. It is further to be appreciated that this embodiment of a multilayer surface comfort device provides additional comfort and support as well as the ability to conform to a shaped body support surface. Moreover, it is to be appreciated that although the embodiment 88 for the surface comfort device illustrated in FIG. 7A is a stand alone device, it may also be integrated into an existing body support device or a surface of a body support device.

For example, many body support devices may include a comfort layer hierarchy (not illustrated), including a lower layer, which may have a rigid support member and, for example, any one or more of straps, webbing (either elastic or non-elastic), springs, straps in combinations with springs, or stretched cloth overlaying a frame of the body support device. The comfort layer hierarchy may also include a middle layer, which may be, for example, a foam or cotton batting, and an upper layer which may include a fabric, for example, leather or a synthetic material, etc., over foam or another textured or contoured cushioning material, or may be a fabric sewed with a batting, or one of various quilted materials. It is to be appreciated that the surface comfort device of the invention may be provided, for example, between the middle layer and the upper layer, or may serve as one of the uppermost layers of such a comfort layer hierarchy, at or near the surface of the body support device and in contact with the body.

Referring again to the embodiment 20 of the surface comfort device illustrated in FIGS. 5–6, it is to be appreciated that the surface comfort device 20 may include an inflatable bladder comprising a plurality of parallel tubes 15. For example, the inflatable surface comfort device may be fabricated with tubes formed by sealing one layer of an air-impervious film directly to another opposing layer of air-impervious film with a number of parallel seams 14, thereby forming a plurality of parallel tubes 15. One advantage of this structure is that it can be easily constructed and is inexpensive. According to this embodiment, the surface comfort device 20 may comprise one or more inflatable bladders formed from at least two layers of air-impervious film, sealed at a perimeter 17 and sealed internally at regular intervals by internal seams 14. Upon inflation, the bladder will comprise a plurality of plural tubes 15 having a generally circular cross-section. It is to be appreciated that the internal seams 14 may be substantially shorter than an overall width w of the bladder to allow for fluid passage between the tubes.

It is to be appreciated that while the surface comfort device 10, 20 of the invention is usually inflated with air, any type of fluid, for example, water, nitrogen, or other liquids or gases, may be used to inflate the surface comfort device. To allow for inflation and deflation, the surface comfort device 10,20 is provided with an adjustment mechanism for any of inflating the surface comfort device, deflating the surface comfort device, or adjusting an amount of fluid within the surface comfort device. For example, one adjustment mechanism might be a manual pump (not illustrated) that, for example, can be manually squeezed to add fluid to the surface comfort device. However, it is to be appreciated that other inflation adjusting mechanisms can also be used, such as an electrically powered pump, or other fluid moving pumps know to those with skill in the art. In addition, the surface comfort device may also be provided with an adjustment mechanism (not illustrated) to allow for deflation of the surface comfort device. For example, the surface comfort device might be provided with a port having a substantial opening and a cover to seal the port, wherein the cover can be removed to exhaust the fluid from the surface comfort device to deflate the device. It is also to be appreciated that other embodiments of the fluid exhausting devices, as known to those with skill in the art, may also be used with the surface comfort device. It is further to be appreciated that the surface comfort device can also be provided with a fluid adjusting device to adjust an amount of fluid within a device to regulate the comfort and support provided by the surface comfort device. For example, the surface comfort device might be provided with a separate fluid adjusting port and a valve (not illustrated) that allows for exhausting small amounts of fluid to regulate the amount of fluid within the surface comfort device. It should be appreciated that any fluid adjusting device known to those with skill in the art can be used with the surface comfort device. In some embodiments of the surface comfort device of the invention, it is desirable to have a fluid adjustment device that is a single mechanism that allows all of inflation, substantial deflation, and adjustment of the amount of fluid in the surface comfort device. One embodiment of a fluid adjustment mechanism is a self-sealing valve, such as valve 16 illustrated herein and discussed below. The self-sealing valve provides for the firmness/softness of the surface comfort device 10,20 to be easily adjusted, according to user preference, and without fumbling, for example, with the related art stem valve and its mating or covering structures, as discussed above. An exemplary embodiment of a self-sealing valve 16 will be described in more detail below. However, it is to be appreciated that many self-sealing valve structures, such as disclosed in U.S. Pat. No. 6,237,621 herein incorporated by reference, can be used with the surface comfort device of the invention.

The surface comfort device 10, 20 of the invention may be provided with fasteners (not illustrated), such as for example, straps, ties, Velcro®, or another type of fastener known to those of skill in the art, to attach the surface comfort device 10 to the body support device. However, it should be appreciated that the surface comfort device of the invention need not be provided as a separate device to be used with a body support device, and instead may be integrated into a body support device as one layer for a multi-layered body support device (as discussed above). For example, a chair may be provided with a surface comfort device integrated into the seat portion of the chair or substantially the entire back portion of the chair, to provide an additional comfort layer. For this embodiment, the self-sealing valve may be adapted such that it also mates with the body support device and may be provided at a convenient location of the chair, such that it can be accessed to inflate or deflate the surface comfort device. Accordingly, the surface comfort device of the invention can be a stand alone device or a device integrated within a body support device.

As stated above, the surface comfort device 10, 20 may include a plurality of substantially parallel tubes 15, as illustrated in FIGS. 5–6. In one embodiment, each tube may have a diameter of approximately 1¼ inches, and a center-to-center spacing between adjacent tubes of approximately 1½ inches. In this embodiment, the surface comfort device may have a total volume of approximately 0.15 cubic feet of fluid at full inflation. This embodiment of the surface comfort device also includes a self-sealing valve 16 to enable inflation and deflation of the bladder. The firmness of the surface comfort device may be adjusted, by controlling the volume of fluid within the bladder with the self-sealing valve, to provide desired comfort and support. In addition when deflated, the surface comfort device is compactable for easy storage.

Figure 8A:
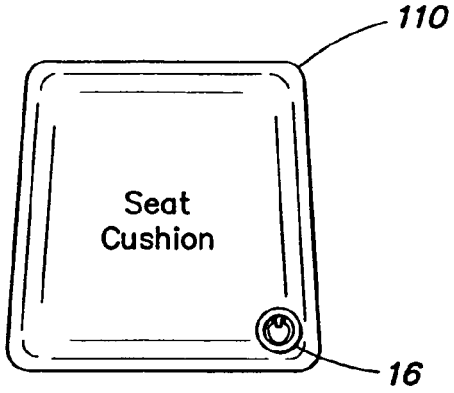
FIGS. 8A–8F are top views of other exemplary embodiments of inflatable surface comfort devices according to the invention.
Figure 8B:
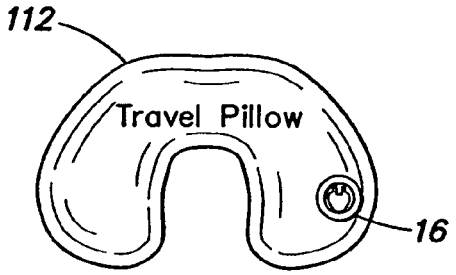
Figure 8C:
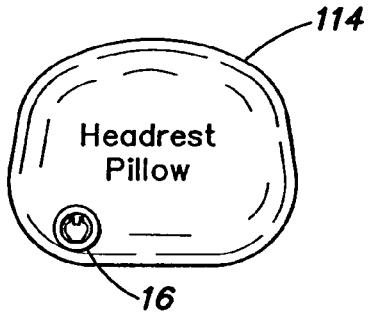
Figure 8D:
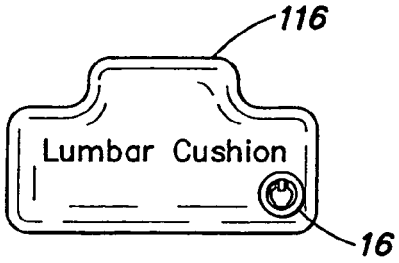
Figure 8E:
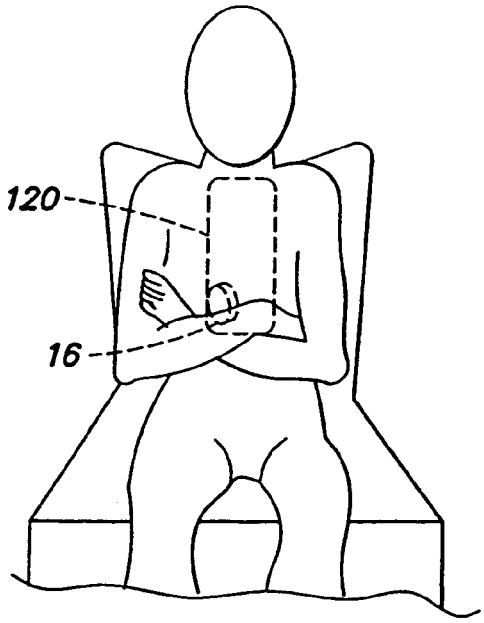
Figure 8F:
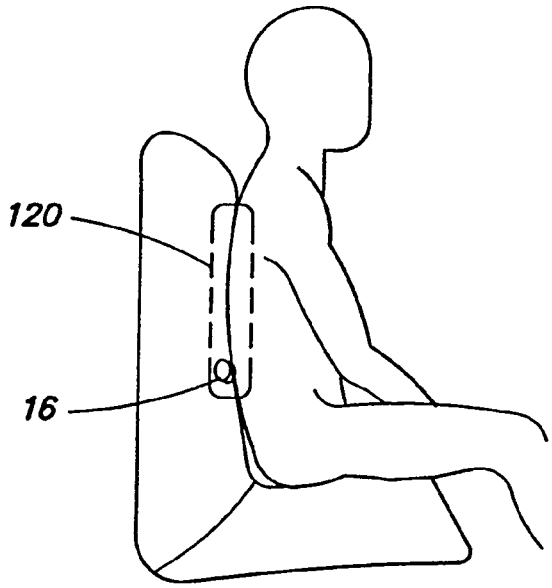
Figure 9A:
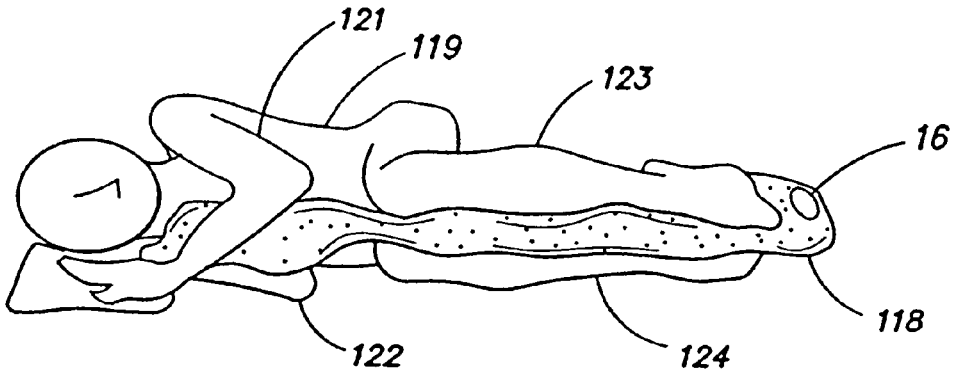
FIGS. 9A–9B illustrate a side view and a top view of an embodiment of a body pillow according to the invention.
Figure 9B:
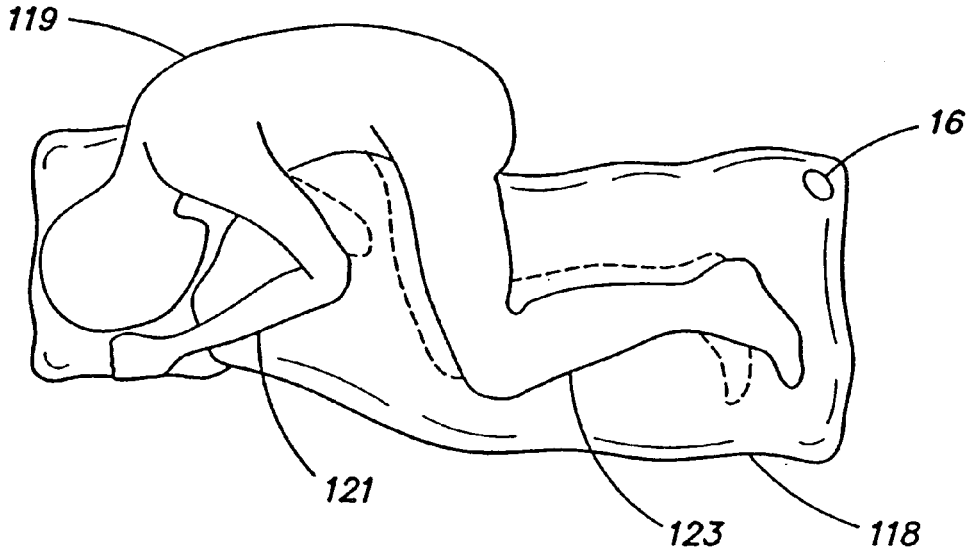
Figure 10:
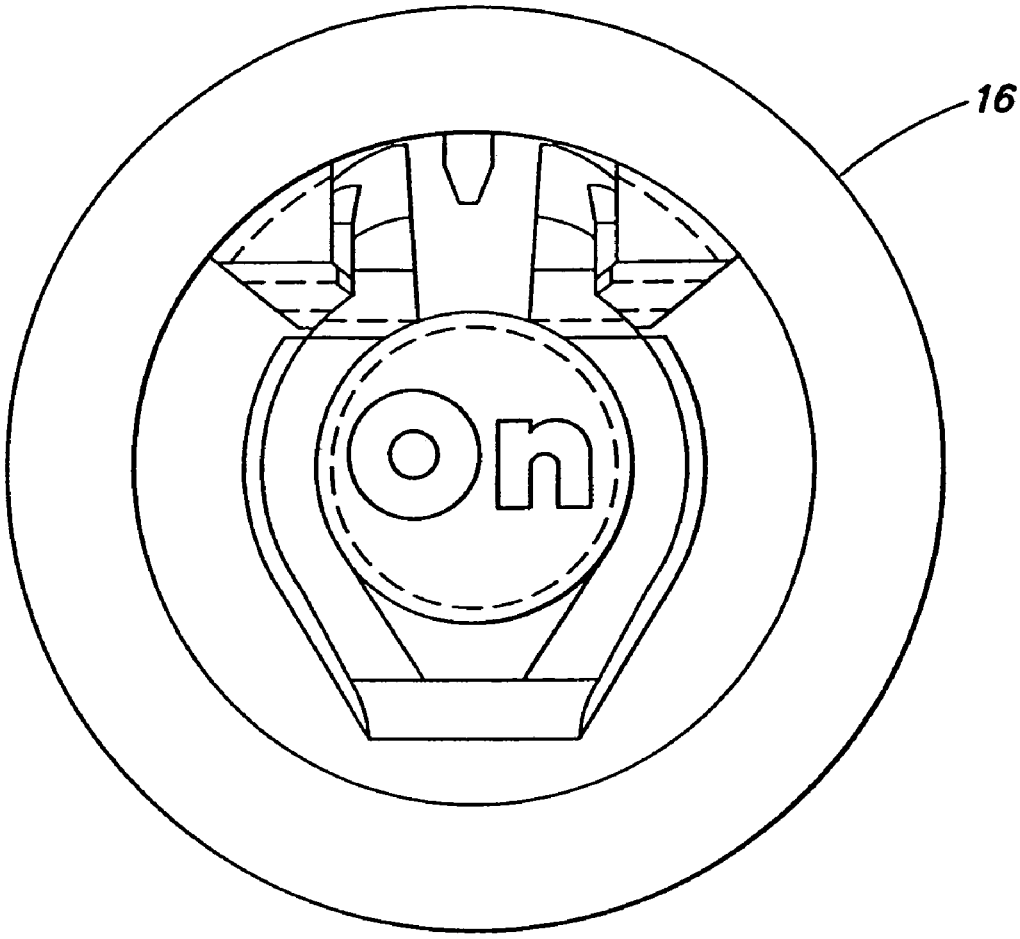
FIG. 10 is an enlarged top view of an embodiment of a self-sealing valve that can be used with various embodiments of the surface comfort device of the invention.
Figure 11:
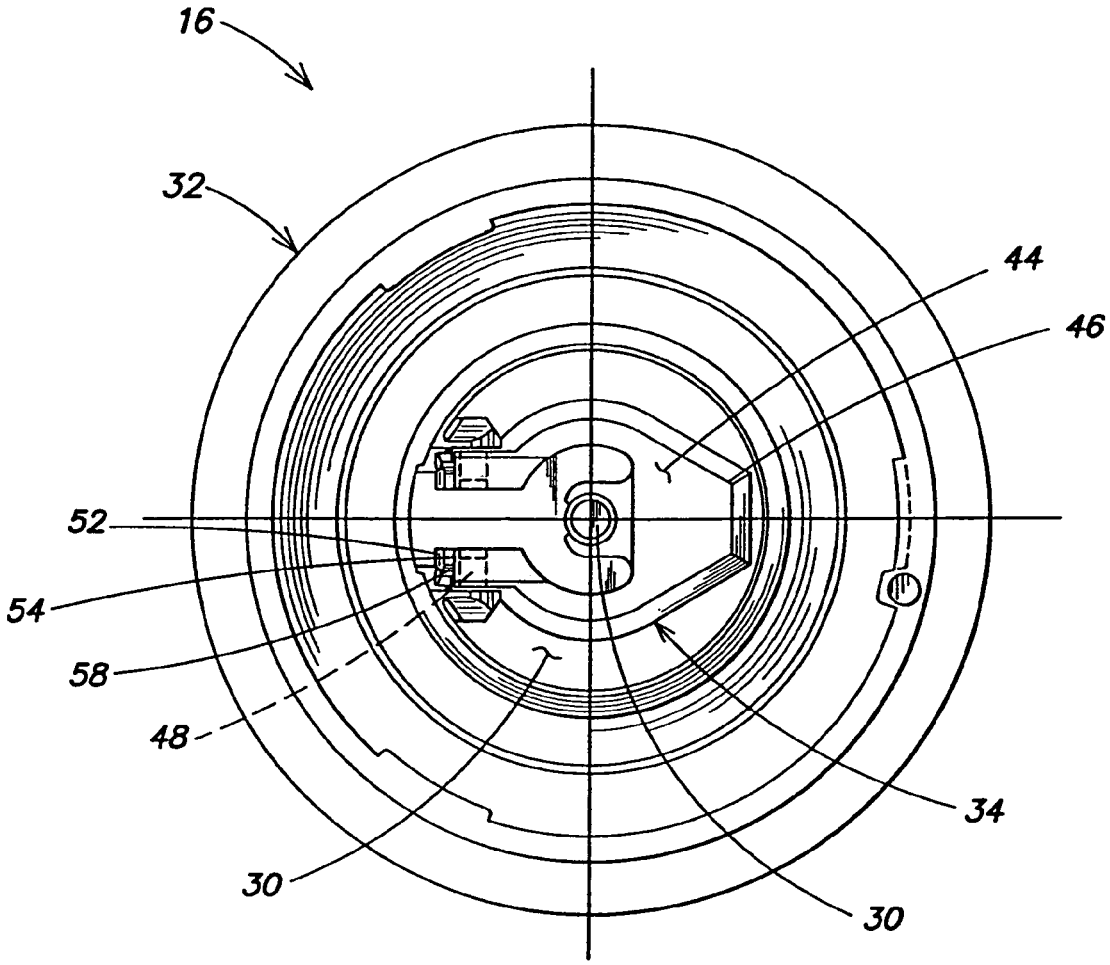
FIG. 11 is a top view of the exemplary embodiment of the self-sealing valve of FIG. 10.
Figure 12:
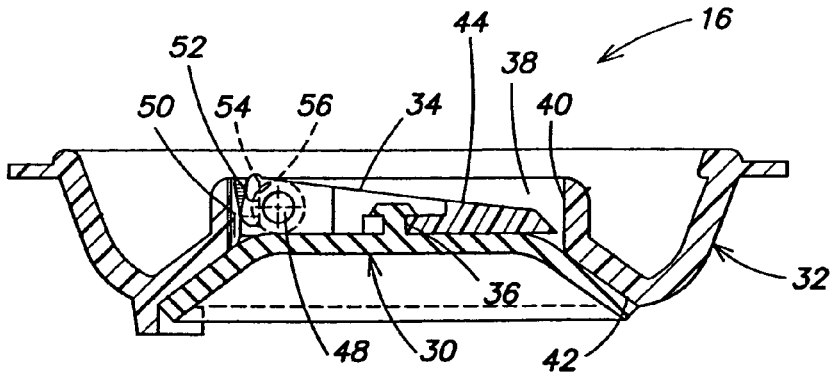
FIGS. 12–14 are cross-sectional side views of the self-sealing valve of FIG. 10.
Figure 13:
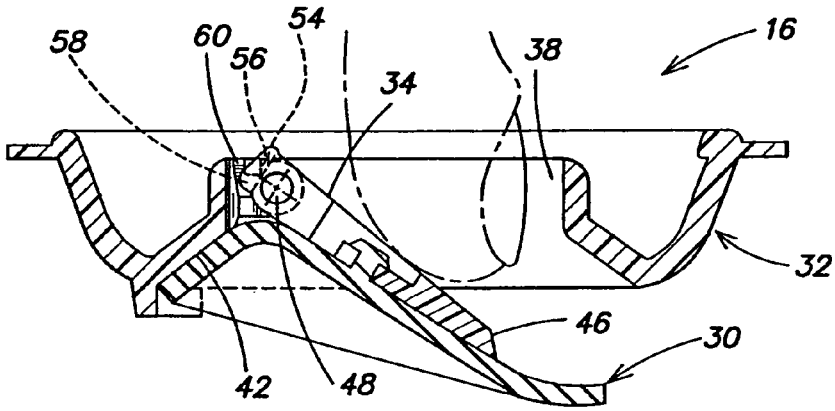
Figure 14:
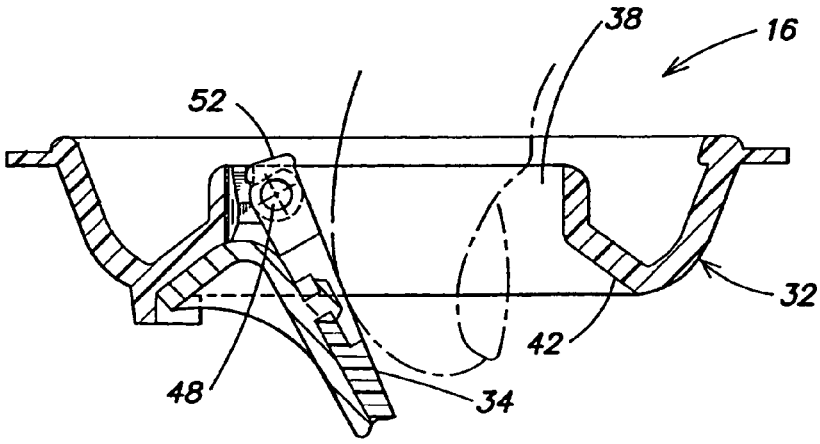

Referring to FIGS. 8A–F, there are illustrated various embodiments of self-sealing, inflatable surface comfort devices according to the invention. FIG. 8A illustrates one device 110 that is sized and shaped to be used as a seat cushion. It is to be appreciated that the surface comfort device 110 may have a smooth or contoured surface, and includes an inflatable bladder. The surface comfort device 110 also includes a self-sealing valve 16 to allow for manual inflation and deflation of the inflatable bladder. In one example, the device 110 may be a low volume device, having less than approximately 0.2 cubic feet of fluid volume when fully inflated. Other examples of low-volume, surface comfort devices include a travel pillow 112 (FIG. 8B), a headrest pillow 114 (FIG. 8C), a lumbar cushion 116 (FIG. 8D), a back support pillow 120 as illustrated (in phantom) in FIG. 8E and FIG. 8F, and a body pillow 118 as illustrated in FIGS. 9A–9B. Each of these surface comfort devices 112, 114, 116 and 118 include an inflatable bladder, and a self-sealing valve 16, as illustrated, to enable inflation and deflation, and to also control firmness of the device. Use of these different embodiments of the surface comfort devices as illustrated in FIGS. 8A–8D and 9A–9B should be readily apparent. For example, each of the travel pillow 112 and the head rest pillow 114 can be used as a pillow for example, when traveling on an airplane, in a car, when camping, and the like. In addition, the lumbar cushion 116 can be used for lower back support with a car seat, office chair, with home furniture, and the like. In addition, the back support pillow 120 illustrated in FIG. 8E and FIG. 8F can be used with a car seat, an office chair and home furniture to provide arch to the back for correct posture and comfort.

Referring to FIGS. 9A–9B, the body pillow 118 can be used, for example, for sleeping on a mattress, when camping, etc . . . to provide comfort, support, and correct posture for sleeping. It is to be appreciated that the volume of fluid within the body support pillow can be varied to accommodate a particular size or shape, for example, of a subject using the body support pillow. It is also to be appreciated that the body support pillow can be used in a number of configurations. For example, the body support pillow may be rolled up into a bolster-like shape to elevate, for example, a lower body of the subject 119. In addition, the body support pillow 118 can be configured to run length wise such that the subject 119 resting on its side can hug the pillow to support the subjects upper-body limbs, providing a layer of cushioning between the upper leg 123 and upper arm 121 that will rest on the body support pillow and the lower leg 124 and lower arm 122 that will rest directly upon, for example, the mattress. It is to be appreciated that as the body support pillow is filled with additional fluid, the body support pillow will further provide cushioning and distance between the upper arm and leg and the lower arm and leg, which can serve both to reduce pressure at points where the upper and lower limbs may come in contact with each other, and provide a more stable body position for sleeping. It is also to be appreciated that the body support pillow also provides improved comfort and well being and improves sleeping posture when used in an appropriate manner. It is further to be appreciated that the body support pillow can be sized and shaped to accommodate a variety of body shapes and sizes. In addition, the body support pillow can comprise one as well as a plurality of inflatable bladders. Further, the body support pillow can be provided with any of a plurality of covering layers and covering layer combinations to provide comfort, temperature control, ventilation and the like. In addition, the body support pillow can be shaped and sized to accommodate a plurality of sleeping positions.

It is to be appreciated that each of these surface comfort devices discussed above with respect to FIGS. 8A–8E and 9A–9B includes a single port, coupled to the self-sealing valve 16, for inflation, deflation and comfort control of the surface comfort device through the single port. The self-sealing valve 16 self-opens upon inflation of the device and self-seals upon cessation of inflation. Inflation can be effected for example, by blowing into the valve or using a pump configured to mate with the valve. The self-sealing valve 16 further allows pressure adjustment, as described below. In one embodiment, the single fluid port may have an unobstructed fluid path that is greater than approximately 0.25 inches in diameter. However, it is to be appreciated that the single fluid port may have other diameters to accommodate different surface comfort devices sizes and fluid flow parameters.

Referring to FIGS. 10–14, there is illustrated an exemplary embodiment of a valve 16 that may be used with the various embodiments of a surface comfort device of the invention. The self-sealing valve 16 may include a diaphragm 30 positioned within a valve housing 32 by a movable hanger arm 34 which suspends the diaphragm from a mounting point 36 in the center of an air inlet 38. The hanger arm 34 is a rotating diaphragm hanger that is removably contained within the air inlet 38 of the valve housing 32, with one end secured adjacent to an inner wall 40 of the air inlet 38. A point of attachment of the one end of the hanger arm 34 to the inner wall 40 is configured to allow the hanger arm 34 to pivot downward into the valve housing 32, a motion which unseats the diaphragm 30 from a valve seat 42, in a closed position, and opens an airpath, to an open position, into the bladder of the surface comfort layer device to allow for both inflation and deflation of the surface comfort layer device.

According to one example, the hanger arm 34 flares outward towards the inner wall 40 of the air inlet 38 creating a "paddle" surface 44 which overspreads much of the air inlet 38. The paddle surface 44 of the hanger arm 34 provides stability to the flexible diaphragm 30 as it rotates with the hanger arm 34 from the closed position to the open position. The expanded paddle surface 44 of the hanger arm 34 also enhances manipulation of the hanger arm 34 by, for example, a fingertip of a user to, for example, control a firmness of the surface comfort layer device. The paddle surface 44 projects outward to a point 46, extending the length of the hanger arm 34. This projection bears upon the flexible diaphragm 30, thereby preventing it from flexing upward when the hanger arm 34 is pressed downward for firmness control or deflation.

The hanger arm 34 may be secured within the air inlet 38 with a pair of hinge pins 48. In one example, there is a contoured section 50 between the hinge pins 48 of the 20 inner wall of at least one of the brackets and the inner wall 40 of the air inlet 38. The contoured section 50 interfaces with a contoured end 52 of the projecting tabs to provide a plurality of distinct interaction possibilities. A first possibility exists when surface 54 on the projecting tabs bears on surface 56 of the inner wall, restricting rotation of the arm above a horizontal position, thereby securing the valve diaphragm in a substantially closed position.

A second possibility exists when a beveled surface 58 on the projecting tab bears on counter-beveled surface 60 on the wall. An inclined angel of this counter-beveled surface 60 causes the projecting tab to increasingly compress inward as the hanger arm 34 is pressed downward into the valve housing 32. This may occur both during inflation (by air pressure) and deflation (by manual deflection of the hanger arm to unseat the valve from the valve seat). The compression of the projecting tab also results in a counter action, so that, with removal of the downward pressure the tab "springs back to its original position and forces the hanger arm 34 and diaphragm 30 to return to the closed position. When the hanger arm 34 is depressed fully, the projecting tabs rotate slightly beyond the beveled surface 60 and lock the rotating arm in a locked open position. This locked open position maximizes airflow through the valve housing and will, under certain conditions improve efficiency of both inflation and deflation. These and other exemplary embodiments of the valve 16 are described in more detail in U.S. Pat. No. 6,237,621, which is herein incorporated by reference.

Figure 15:
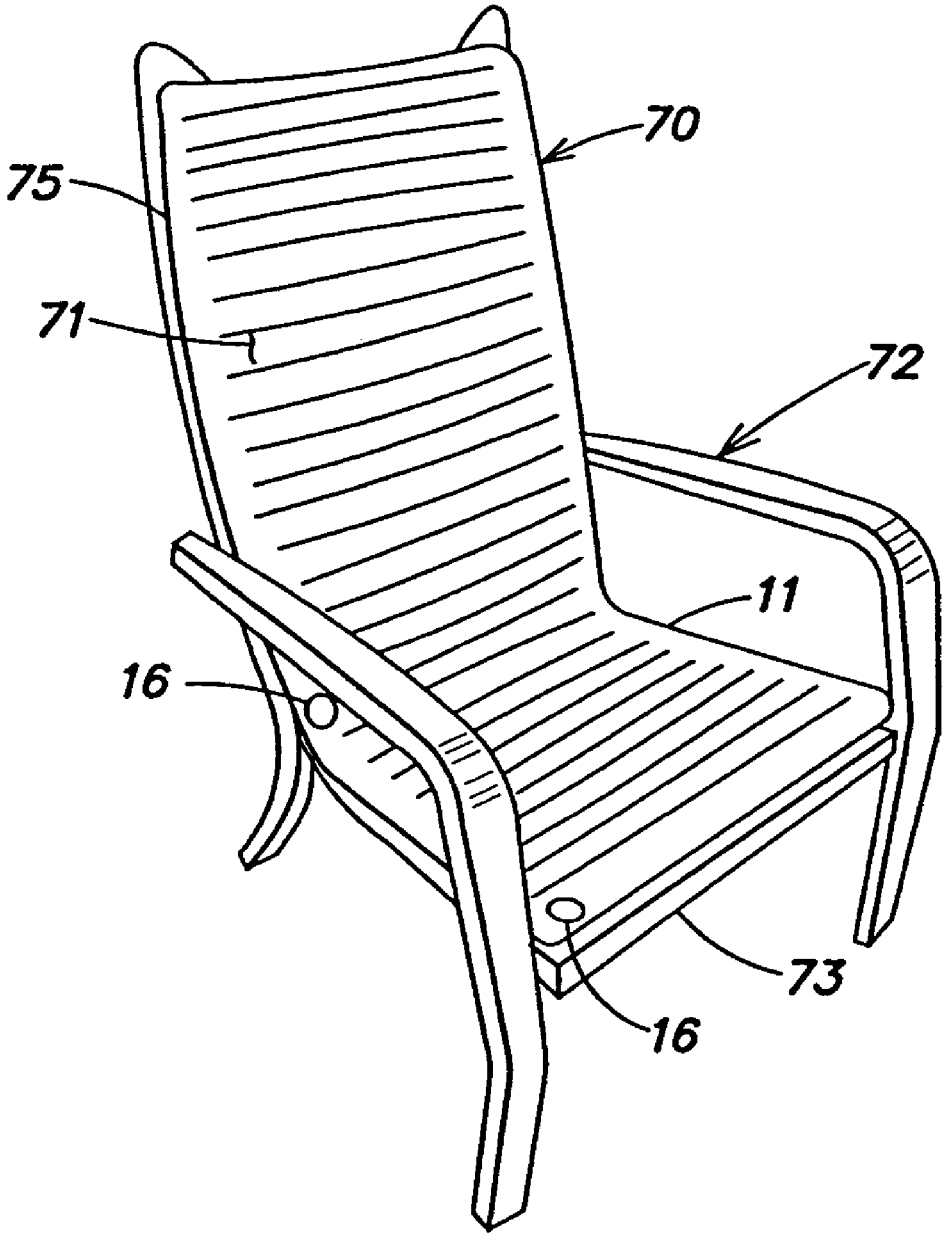
FIG. 15 is a perspective view of another embodiment of a surface comfort device according to the invention.

Referring now to FIG. 15, there is illustrated another embodiment of a surface comfort device 70 adapted to be used as a comfort layer for covering substantially all of a seat and seat back of a chair 72. It is to be appreciated that this embodiment of the surface comfort device 70 may comprise more than one fluid impermeable bladder, such as for example, two fluid impermeable bladders 11 and 71, one for substantially covering and conforming to the seat cushion 73 and one for substantially covering and conforming to the seat back 75. It is also to be appreciated that this embodiment of the surface comfort device 70 may be provided with either a single valve 16, or multiple self-sealing valves 16, such as one for each fluid impermeable bladder, to allow for variable firmness in any of the seat and seat back portions of the surface comfort device 70.

It is to be appreciated, in general, that in some applications, it is desirable that the surface comfort device overspread as much as possible of a body support device with which the surface comfort device is to be used. Therefore, the surface comfort device of the invention may be provided in a number of different shapes and sizes, adapted to be used with a number of different sized and shaped body support devices, to accommodate different sized chairs, bedding, office and home furniture, etc. In addition, the surface comfort device of the invention may be provided with at least one or more additional cover layers, for example, a quilted or textured layer, to enhance comfort, to provide a protective layer, to reduce noise, and the like. In one embodiment, a variety of attachable cover layers may be provided with the surface comfort device. It is further to be appreciated that an outer layer of the surface comfort device may further be provided in a variety of different colors.

Having thus described various illustrative non-limiting embodiments, and aspects thereof, modifications and alterations will be apparent to those who have skill in the art. Such modifications and alterations are intended to be included in this disclosure, which is for the purpose of illustration and explanation, and not intended to define the limits of the invention. The scope of the invention should be determined from proper construction of the appended claims and their equivalents.

The invention claimed is:

1. An inflatable, surface comfort device comprising:

an inflatable bladder having a first flexible surface and a second flexible surface opposite the first flexible surface, and having a port through which inflation of the inflatable bladder is accomplished, the inflatable bladder having a shape and size to conform to a surface of a body support device, the surface of the body support device configured such that it is contoured at least when in use, the inflatable bladder so sized and shaped such that (i) an area of the first flexible surface substantially completely covers the surface of the body support device, and (ii) the average, fully inflated thickness defined between the first flexible surface and the second flexible surface is less than substantially 2 inches, and whereby when the first flexible surface is operatively coupled to the surface of the body support device, the first flexible surface conforms to the surface of the body support device, and the shape of the surface of the body support device is substantially transferred to a user contacting the second flexible surface; and a valve coupled to the port of the inflatable bladder that is constructed and arranged to enable inflation, of the surface comfort device.

2. The surface comfort device of claim 1, wherein the port has a diameter of greater than approximately 0.25 inches.

3. The surface comfort device of claim 1, wherein the valve comprises a self-sealing valve adapted to enable adjustment of a pressure of a fluid within the inflatable bladder by manually pressing a portion of a diaphragm on the self-sealing valve.

4. The surface comfort device of claim 1, wherein the surface comfort device is shaped and arranged in the form of a seat cushion.

5. The surface comfort device of claim 4, wherein the inflatable bladder comprises a total volume of no more than 0.3 cubic feet of fluid when fully inflated.

6. The surface comfort device of claim 1, wherein the surface comfort device is shaped and arranged in the form of a pillow.

7. The surface comfort device of claim 6, wherein the inflatable bladder comprises a total volume of no more than 0.3 cubic feet of fluid when fully inflated.

8. The surface comfort device of claim 1, wherein the surface comfort device is shaped and arranged in the form of a lumbar support device.

9. The surface comfort device of claim 8, wherein the inflatable bladder comprises a total volume of no more than 0.3 cubic feet of fluid when fully inflated.

10. A surface comfort device of claim 1, wherein the surface comfort device is shaped and arranged in the form of a body pillow.

11. A surface comfort device of claim 10, wherein the inflatable bladder comprises the total volume of no more than 3.0 cubic feet of fluid when fully inflated.

12. The surface comfort device of claim 1, wherein the inflatable bladder comprises a plurality of parallel tubes.

13. The surface comfort device of claim 12, wherein each tube of the plurality of parallel tubes has a diameter of approximately 1.25 inches.

14. The surface comfort device of claim 1, wherein the surface comfort device is shaped and sized to cover substantially an entire surface of a seat back and a seat cushion.

15. The surface comfort device of claim 14, wherein the inflatable bladder comprises a total volume of less than approximately 2 cubic feet when fully inflated.

16. The surface comfort device of claim 14, wherein the surface comfort device comprises a first bladder and a second bladder.

17. The surface comfort device of claim 1, wherein the surface comfort device is shaped and arranged in the form of a cylinder.

18. The surface comfort device of claim 1, wherein the body support device comprises a mattress and the surface comfort device is sized and shaped to conform to a surface of the mattress.

19. The surface comfort device of claim 1, wherein the fully inflated thickness defined between the first flexible surface and the second flexible surface is less than 2 inches across the entire inflatable bladder.

20. An adjustable, inflatable, surface comfort device comprising:

an inflatable bladder having a first flexible surface and a second flexible surface opposite the first flexible surface, and having a shape and a size including an average, fully inflated thickness defined between the first flexible surface and the second flexible surface of less than substantially 2 inches, such that the first flexible surface is adapted to cover and conform to substantially all of at least one body support surface of a shaped body support device, whereby when the first flexible surface is in contact with the body support surface of the contoured body support device, the first flexible surface conforms to the surface of the shaped body support device, the surface of the contoured body support device being contoured at least when in use, and the shape of the surface is transferred to a user contacting the second flexible surface; and an adjustment mechanism that provides for inflation, deflation, and adjustment of an amount of fluid within the inflatable bladder to adjust a comfort and support provided by the surface comfort device.

21. The surface comfort device of claim 20, wherein the adjustment mechanism comprises a self-sealing valve coupled to a port on the inflatable bladder.

22. The surface comfort device of claim 21, wherein the port has a diameter of greater than approximately 0.25 inches.

23. The surface comfort device of claim 21, wherein the self-sealing valve is adapted to enable adjustment of a pressure of a fluid within the inflatable bladder by manually pressing a portion of a diaphragm on the self-sealing valve.

24. The surface comfort device of claim 20, wherein the surface comfort device is shaped and arranged in the form of a seat cushion.

25. The surface comfort device of claim 24, wherein the inflatable bladder comprises a total volume of no more than 0.3 cubic feet of fluid when fully inflated.

26. The surface comfort device of claim 20, wherein the surface comfort device is shaped and arranged in the form of a pillow.

27. The surface comfort device of claim 26, wherein the inflatable bladder comprises a total volume of no more than 0.3 cubic feet of fluid when fully inflated.

28. The surface comfort device of claim 20, wherein the surface comfort device is shaped and arranged in the form of a lumbar support device.

29. The surface comfort device of claim 28, wherein the inflatable bladder comprises a total volume of no more than 0.3 cubic feet of fluid when fully inflated.

30. A surface comfort device of claim 20, wherein the surface comfort device is shaped and arranged in the form of a body pillow.

31. A surface comfort device of claim 30, wherein the inflatable bladder comprises the total volume of no more than 3.0 cubic feet of fluid when fully inflated.

32. The surface comfort device of claim 20, wherein the inflatable bladder comprises a plurality of parallel tubes.

33. The surface comfort device of claim 20, wherein the surface comfort device is shaped and sized to cover substantially an entire surface of a seat back and a seat cushion.

34. The surface comfort device of claim 33, wherein the inflatable bladder comprises a total volume of no more than approximately 2 cubic feet of fluid when fully inflated.

35. The surface comfort device of claim 33, wherein the surface comfort device comprises a first bladder and a second bladder.

36. The surface comfort device of claim 20, wherein the surface comfort device is shaped and arranged in the form of a cylinder.

37. The surface comfort device of claim 20, wherein the body support device comprises a mattress and the surface comfort device is sized and shaped to conform to a surface of the mattress.

38. The surface comfort device of claim 20, wherein the fully inflated thickness defined between the first flexible surface and the second flexible surface is less than 2 inches across the entire inflatable bladder.

* * * * *

UNITED STATES PATENT AND TRADEMARK OFFICE

CERTIFICATE OF CORRECTION

PATENT NO. : 7,000,276 B2
APPLICATION NO. : 10/412075
DATED : February 21, 2006
INVENTOR(S) : Robert B. Chaffee It is certified that error appears in the above-identified patent and that said Letters Patent is hereby corrected as shown below:

In column 5, line 67, delete the numeral –7A-- and insert the numeral –7--.

Signed and Sealed this

Eighth Day of August, 2006

JON W. DUDAS
*Director of the United States Patent and Trademark Office*